US011761309B2

(12) United States Patent
AlSayed et al.

(10) Patent No.: US 11,761,309 B2
(45) Date of Patent: Sep. 19, 2023

(54) SYSTEM AND METHOD FOR INCORPORATING A VELOCITY SPOOL (EJECTOR) IN A CORROSION INHIBITION SYSTEM

(71) Applicant: Saudi Arabian Oil Company, Dhahran (SA)

(72) Inventors: Khaled Ali AlSayed, Udhailiyah (SA); Saud F. AlSadhan, Al Ahsa (SA)

(73) Assignee: Saudi Arabian Oil Company, Dhahran (SA)

( * ) Notice: Subject to any disclaimer, the term of this patent is extended or adjusted under 35 U.S.C. 154(b) by 306 days.

(21) Appl. No.: 16/998,575

(22) Filed: Aug. 20, 2020

(65) Prior Publication Data

US 2022/0056786 A1 Feb. 24, 2022

(51) Int. Cl.

| | |
|---|---|
| ***E21B 41/00*** | (2006.01) |
| ***E21B 41/02*** | (2006.01) |
| ***B05B 7/26*** | (2006.01) |

(52) U.S. Cl.

CPC ..... *E21B 41/02* (2013.01); *B05B 7/262* (2013.01); *E21B 41/0078* (2013.01)

(58) Field of Classification Search

CPC ..... E21B 37/06; E21B 41/0078; E21B 41/02; B05B 7/262

See application file for complete search history.

(56) References Cited

U.S. PATENT DOCUMENTS

| | | | | |
|---|---|---|---|---|
| 3,053,320 | A * | 9/1962 | Steincamp | E21B 41/02 166/68 |
| 6,343,653 | B1 * | 2/2002 | Mason | E21B 37/06 166/310 |
| 9,359,677 | B2 * | 6/2016 | Mackenzie | C23F 11/10 |
| 2018/0291836 | A1 | 10/2018 | Langenfeld et al. | |
| 2020/0173941 | A1 * | 6/2020 | Lovell | G01N 24/10 |

FOREIGN PATENT DOCUMENTS

| | | |
|---|---|---|
| CN | 1920248 | 2/2007 |
| CN | 101762109 | 5/2012 |
| WO | WO 2019206975 | 10/2019 |

OTHER PUBLICATIONS

PCT International Search Report and Written Opinion in International Appln. No. PCT/US2021/046645, dated Nov. 9, 2021, 14 pages.

* cited by examiner

*Primary Examiner* — Matthew R Buck
(74) *Attorney, Agent, or Firm* — Fish & Richardson P.C.

(57) ABSTRACT

The present disclosure describes a wellhead system that includes a wellhead; a tank of corrosion inhibitor chemical; and an ejector device comprising: a high pressure nozzle connected to the wellhead through a first flowline; a low pressure nozzle connected to the tank of corrosion inhibitor chemical through a second flowline; and wherein the ejector device is configured to generate a gas and chemical mixture fluid that exits the ejector device and flows downstream of the wellhead system.

19 Claims, 4 Drawing Sheets

SYSTEM AND METHOD FOR INCORPORATING A VELOCITY SPOOL (EJECTOR) IN A CORROSION INHIBITION SYSTEM

TECHNICAL FIELD

This disclosure generally relates to improvements to a corrosion inhibition system for a gas well operation.

BACKGROUND

Gas wells can be scattered and cover a wide geographical area. The geographic span can imply a significant overhead for running, for example, daily operational checks when employees drive long distances to verify the functionality of the gas wells with corrosion injection system pumps.

SUMMARY

In one aspect, the present disclosure describes a wellhead system that includes: a wellhead; a tank of corrosion inhibitor chemical; and an ejector device comprising: a high pressure nozzle connected to the wellhead through a first flowline; a low pressure nozzle connected to the tank of corrosion inhibitor chemical through a second flowline; and wherein the ejector device is configured to generate a gas and chemical mixture fluid that exits the ejector device and flows downstream of the wellhead system.

Implementations may include one or more of the following features.

The ejector device may further include: a converging nozzle distal to the high pressure nozzle and the low pressure nozzle, wherein the converging nozzle is configured to convert a pressure of fluid from the first flowline to create a low pressure zone that provides a motive gas to entrain fluid from the second flowline such that the gas and chemical mixture fluid is created. The fluid from the second flowline may contain sufficient dose of corrosion inhibitor chemical to protect pipelines downstream of the wellhead system from corrosion. The converging nozzle may be configured to increase a fluid velocity of the fluid from the first flowline such that a high static pressure of the fluid from the first flowline is transformed into a velocity pressure that results in the low pressure zone. The ejector device may further include a diffuser section located distal to the converging nozzle. The diffuser section may further include a diverging nozzle configured to reduce a velocity of the gas and chemical mixture fluid and increase a pressure of the gas and chemical mixture fluid such that the gas and chemical mixture fluid is re-compressed before exiting the ejector device. The gas and chemical mixture fluid may exit the ejector device to reach facilities downstream of the wellhead system. The tank of corrosion inhibitor chemical may include a restriction orifice (RO). The restriction orifice may be configured to restrict a dosage of the corrosion inhibitor chemical being released at the ejector device. The restriction orifice may be configured to avoid an over-dosage of the corrosion inhibitor chemical being released at the ejector device.

The wellhead system may further include a pressure choke valve connected to the wellhead through a third flowline. The ejector device may be located upstream of the pressure choke valve. The ejector device may be without a rotating component. The wellhead system may further include a communication device configured to communicate data encoding a measured concentration of the corrosion inhibitor chemical in the gas and chemical mixture fluid.

In another aspect, the present disclosure describes a computer-implemented method that includes: accessing data encoding a measurement of a concentration of a corrosion inhibitor chemical in a mixture fluid exiting a wellhead system; and controlling a dose of the corrosion inhibitor chemical being released at an ejector device of the wellhead system such that the concentration of the corrosion inhibitor chemical in the mixture exiting the wellhead system is within a pre-determined range.

Implementations may include one or more of the following features.

In response to the concentration being lower than a pre-determined threshold level, the process may enlarge an opening of a restriction orifice (RO) at a tank of the corrosion inhibitor chemical such that a quantity of the corrosion inhibitor chemical being released at the ejector device of the wellhead system is increased. In response to the concentration being lower than a pre-determined threshold level, the process may reduce an opening of a restriction orifice (RO) at a tank of the corrosion inhibitor chemical such that a quantity of the corrosion inhibitor chemical being released at the ejector device of the wellhead system is decreased. The process may further include: monitoring the concentration of the corrosion inhibitor chemical in the mixture fluid exiting the wellhead system.

The process may further include applying renewable energy to power at least one piece of active equipment of the wellhead system, wherein the renewable energy is harvested onsite at the wellhead system.

Implementations according to the present disclosure may be realized in computer implemented methods, hardware computing systems, and tangible computer readable media. For example, a system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

The details of one or more implementations of the subject matter of this specification are set forth in the description, the claims, and the accompanying drawings. Other features, aspects, and advantages of the subject matter will become apparent from the description, the claims, and the accompanying drawings.

DESCRIPTION OF DRAWINGS

Like reference numbers and designations in the various drawings indicate like elements.

DETAILED DESCRIPTION

Figure 1:
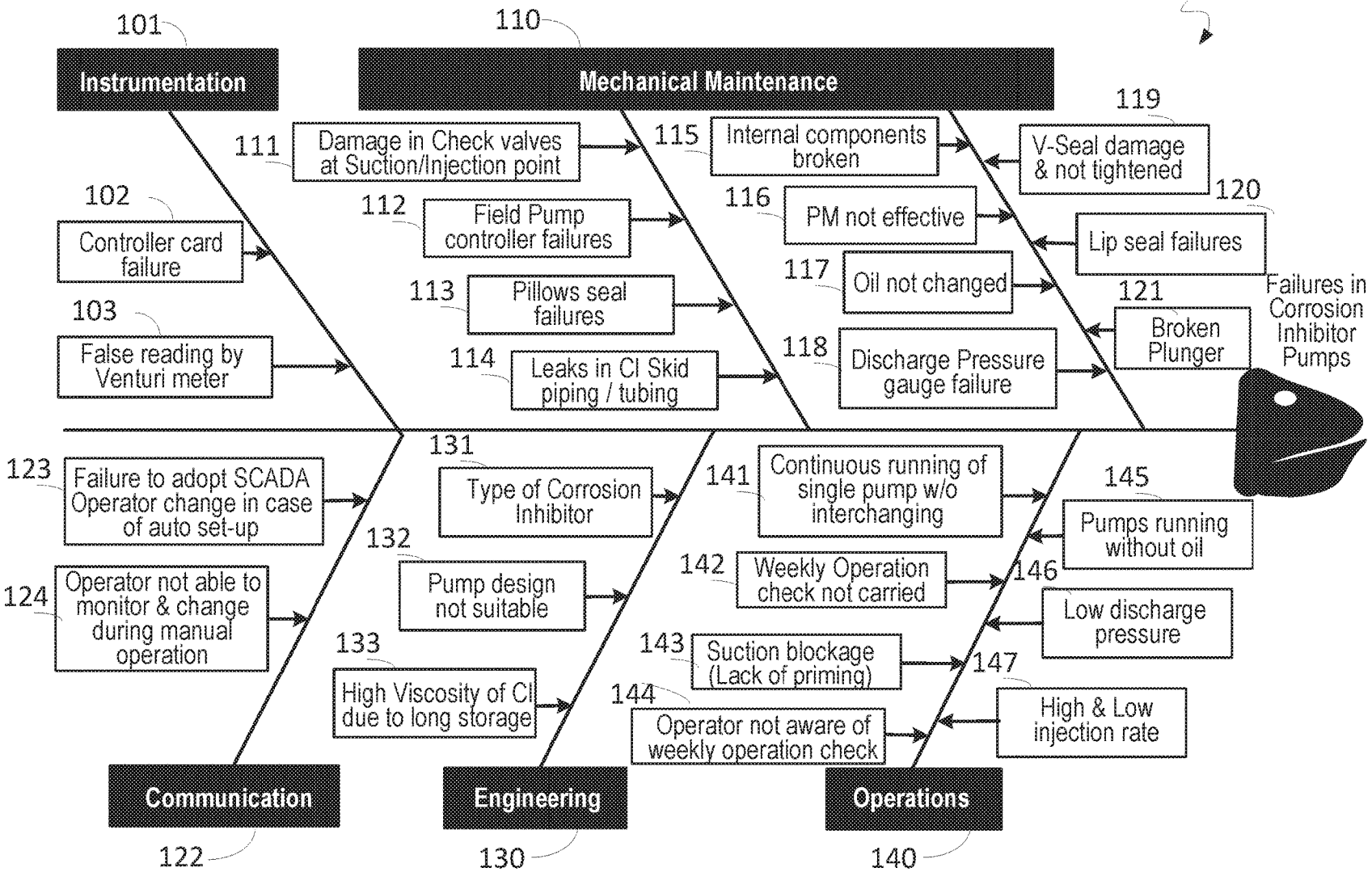
FIG. 1 illustrates examples of corrosion inhibitor pump failures.

The disclosed technology is directed to system and method to use a velocity spool (also known as an ejector device) with restriction orifice (RO) at gas wells to replace, for example, corrosion inhibition reciprocating pumps. By installing jet-pump ejector or velocity-spool as a form of stationary equipment, rotating equipment, such as reciprocating pump can be replaced. The replacement can significantly improve the system reliability, availability, integrity and exchangeability. The improvement pertains to maintenance. For example, maintenance cost will be significantly reduced when reciprocating pumps typically consume large amounts of electricity.

Specifically, in some implementations, a jet-pump (or an ejector or velocity spool) can be installed at a wellhead upstream choke valve to exploit the high pressure from the well before the pressure is dropped by the choke valve. The present disclosure may use jet-pump, ejector, or velocity spool interchangeably. In these implementations, the motive gas can be attained by connecting the high pressure (HP) nozzle to the gas well stream piping (which is upstream of the choke valve). The low pressure (LP) nozzle, on the other hand, is connected to the corrosion chemical tank with restriction orifice (RO) in order to avoid an over-dosage scenario. The output of the ejector can be connected to the downstream piping after the choke valve.

In various implementations, installing a velocity-spool, which is a stationary equipment, to replace a rotating equipment such as a reciprocating pump, can significantly improve the system reliability, availability, integrity and exchangeability. Additionally, the maintenance expense can be significantly lowered by virtue of the effectively zero maintenance and the reduced electricity consumption. For example, using such stationary equipment can reduce the consumption of electricity whereas reciprocating pumps are often considered as one of the largest consumers of electricity. By eliminating these pumps, solar power supply (i.e., renewable energy) can be used to power up the gas well equipment as well as communication and display devices of the system, such as, for example, a communication panel, or a remote terminal unit (RTU). In other words, replacing the rotating equipment obviates the need for conventional power source through a dedicated power line (overhead or underground) to each well. The savings in cost and energy generally scales up with the number of wells.

Gas wells are often scattered in a wide geographical area of hundreds of kilometers wide (e.g., more than 300 km by 150 km in area). This geographic coverage often calls for daily operational checks by employees who may drive long distance to verify the functionality of the gas wells. The inspection may mainly focus on corrosion inhibitor injection pumps. For context, a corrosion inhibitor is a chemical compound that, when added to a liquid or gas, decreases the corrosion rate of a material, typically a metal or an alloy, which comes into contact with the fluid. For example, high oil and gas prices are favoring the utilization of beds with lower oil and gas yields, as well as the recovery of fields with small usable portions or high water/$CO_2$/$H_2$ S portions. In this example, the injection of corrosion inhibitor can become indispensable for efficient conveyance.

As a general matter, a corrosion inhibitor system is a crucial system on each individual well. A corrosion inhibitor system may be comprised of corrosion inhibitor injection pumps and other components. The corrosion inhibitor injection pumps are positive displacement pumps that allow corrosion inhibitor to be injected into the gas pipeline to protect the carbon steel gas pipelines and the downstream gas network facilities. In case of failure of a corrosion inhibitor injection pump, the gas well may be shut down in order to avoid corrosion buildup, which, in turn, can lead to leaks on the piping network. When leaks develop on the pipe, production loss is expected. Indeed, potential pipe leakage resulting from failure of a corrosion inhibitor injection pump can negatively impact the overall system integrity and reliability. Such production loss give rise to supply chain severance.

To mitigate pipe leakage due to corrosion, gas wells are often equipped with corrosion inhibition reciprocating pumps (for example, 2 pumps per well). Over time, the number of gas wells are increasing gradually (for example, approximately 10% per year). A reciprocating pump is a class of positive-displacement pumps which utilizes a plunger or piston to change a cavity's volume, and produce a pressure differential. The class of reciprocating pumps include the piston pump, plunger pump, and diaphragm pump. For example, a plunger pump operates using the reciprocating motion of plungers or pistons. Depending on the design of the pump, the use of a single or multiple plungers may be used. Reciprocating pumps are known for their low reliability and high maintenance cost associated with the moving parts. In the reciprocating pumps, as the intended daily dosage of corrosion inhibitors is very low with very high pressure (10K PSI), the successful continuous operation becomes exceptional and challenging. For example, the intended dosage can be within about 0.38-0.75 Gallon per million standard cubic feet per day (MMSCFD). In some cases, the reliability of these pumps led to a root cause analysis (RCA) that has revealed a combination of corrosion inhibition pumps failures. Several root cases can be identified and attributed to the various aspects of mechanical, electrical, instrumentational, operational, engineering and communication.

Referring to FIG. 1, diagram 100 illustrate examples of failures in corrosion inhibitor pumps. In general, failures can come in five different classes, namely, instrumentation 101, mechanical maintenance 110, communication 122, engineering 130, and operations 140. Failure under instrumentation 101 may include controller card failure 102, and false reading by venturi meter 103. A venturi meter is flow measurement instrument which use a converging section of pipe to give an increase in the flow velocity and a corresponding pressure drop from which the flowrate can be deduced.

Mechanical maintenance 110 may generally include several modes of failure, for example, damage in check valves at suction/injection point 111, field pump controller failures 112, pillow seal failures 113, and leaks in chemical injection (CI) skid piping/tubing 114. In some examples, due to the repetitive failure of a CI pump, the well may be forced to shut down to protect the export pipeline network from the very corrosive service (Sour/Sweet) hydrocarbon gas. In these examples, the CI pump is reciprocating and it is not a shelf item with low reliability due to the system high pressure. Failures under mechanical maintenance 110 may additionally include broken internal components 115, ineffective preventive maintenance (PM) 116, unchanged oil 117, discharge pressure gauge failure 118, V-seal damage and unable to tighten (119), lip seal failure 120, and broken plunger (121).

Failures under communication 122 may generally include failure to adopt supervisory control and data acquisition (SCADA) operator change 123 (under automatic setup) and inability of an operator to monitor and change (for example, corrosion inhibitor) during manual operation 124.

Failures under engineering 130 may generally include incorrect type of corrosion inhibitor 131, unsuitable pump design 132, and high viscosity of chemical injection (which can be caused by long periods of storage) 133. For example, inadequate chemical storage can lead to change the pumping fluid characteristics that is not conducive to controlled release and mixing.

Failures under operations 140 may generally include continuous running of single pump without interchanging 141, failure to conduct weekly operational check 142, suction blockage 143, and operator unawareness of the weekly operational check 144. Here, suction blockage 143 can be caused by lack of priming. For example, direct blockage to the pump suction can have similar effect as if the pump has not been primed.

Failures under operation 140 may additionally include pumps runout without oil 145, low discharge pressure 146, and high and low injection rate 147. For illustration, when the pump is working, the discharge pressure can fall below the gas stream pressure at the injection point, rending the chemical unable to flow to the stream. As described above, the intended dosage can be within about 0.38-0.75 Gallon per million standard cubic feet per day (MMSCFD). Injection rates outside this range may not achieve the intended corrosion inhibition.

Some implementations of the present disclosure seek to employ an ejector in the corrosion inhibition system by supplanting the positive displacement pumps on gas wells. Due to the large number of gas wells, which can significantly improve safety and reliability profiles of the gas wells. An example of an ejector may use a converging nozzle to increase the fluid velocity to transform a high static pressure into velocity pressure. This conversion of static pressure to velocity pressure results in a low pressure zone that provides the motive force to entrain a side fluid. The mixed fluid then flows through a diffuser section that includes a diverging nozzle which can then reduce the velocity and increases the pressure, thereby re-compressing the mixed fluid. The ejector may also be known as a velocity spool. In contrast to positive displacement pumps with rotating parts, the ejector device can be a stationary device. A stationary device is expected to withstand wear and tear much better than a device with moving parts. In addition to simplicity, an ejector device enjoys cost benefit. As a result, the replacement can systematically increase the availability of the gas wells and significantly improve equipment integrity. These advantages may manifest as reduced electricity, maintenance and material overheads, as well as simplified tie-ins, infrastructures, material procurement, and construction.

Figure 2:
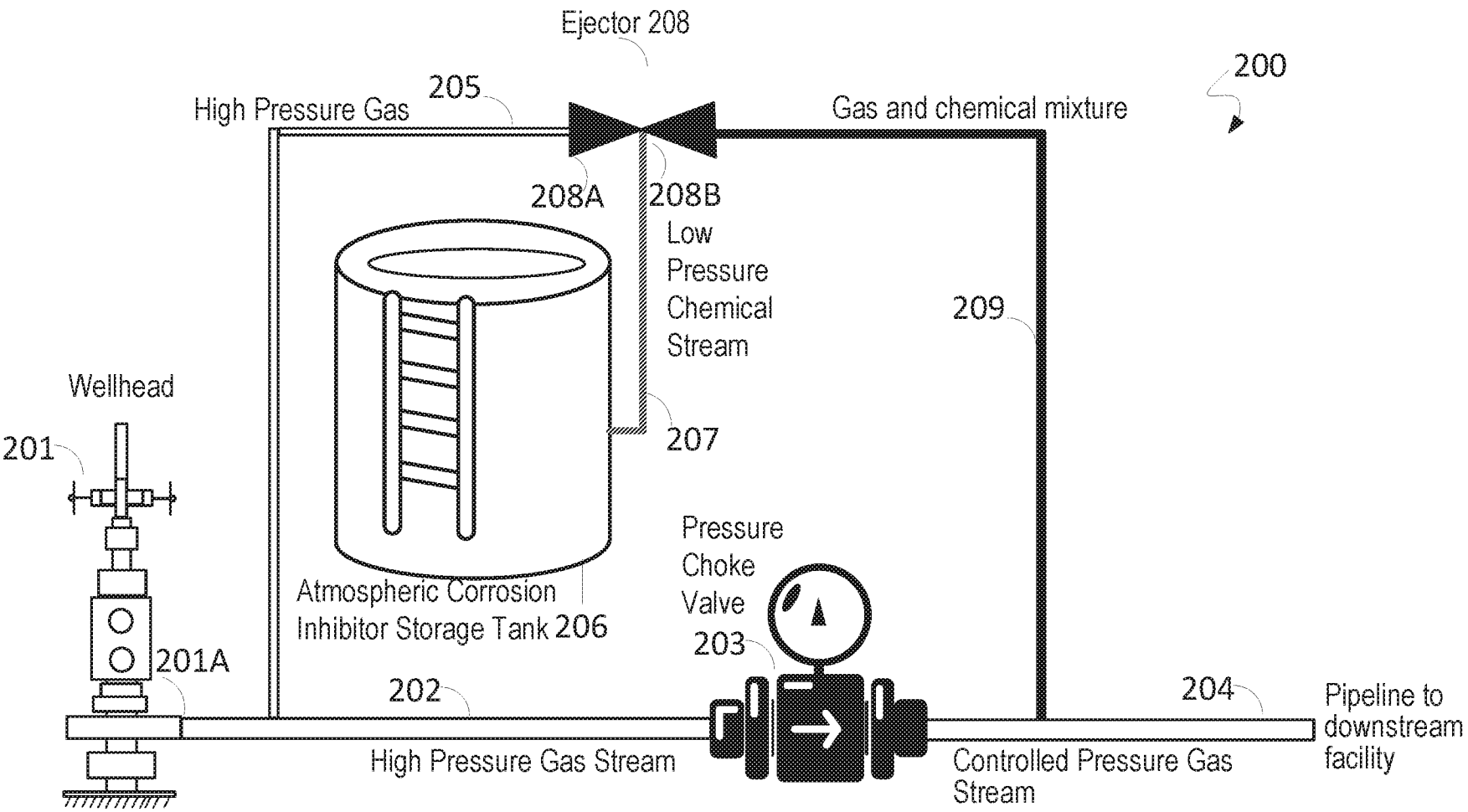
FIG. 2 illustrates an example of incorporating an ejector device in a wellhead system according to an implementation of the present disclosure.

FIG. 2 is a diagram 200 illustrating an example of incorporating an ejector 208, as a stationary equipment without rotating parts, in a well head operation. Here, well head 201 is a surface termination of a wellbore that incorporates facilities for installing, for example, casing hangers during the well construction phase. The wellhead 201 may also incorporate surface flow-control facilities in preparation for the production phase of the well. Through exit 201A, wellhead 201 outputs high pressure gas. In this example, high pressure gas stream 202 flows to pressure choke valve 203 through flow line 202. Pressure choke valve 203, also known as pressure choker valve, is a type of control valve that controls the flow of well fluids being produced. The pressure choke valve can also kill the pressure from reservoir and to regulate the downstream pressure in the flow lines. The flow lines here refer to a surface pipeline carrying, for example, oil, gas or water that connects the wellhead to a manifold or to production facilities, such as heater-treaters and separators. Pressure choke valve 203 can allow fluid flow through a very small opening, designed to kill the reservoir pressure while regulating the well production.

Here, ejector 208 can be installed at a wellhead at a location that is upstream the pressure choke valve 203 to take full advantage of the well's high pressure near exit 201A before the pressure is dropped by the pressure choke valve 203. In more detail, flow line 205 connects exit 201A to a high pressure (HP) nozzle 208A at ejector 208. In other words, high pressure gas may flow from exit 201A to high pressure nozzle 208A. Meanwhile, a low pressure (LP) nozzle 208B is connected, via flow line 207, to the atmospheric corrosion inhibitor chemical tank 206 with a restriction orifice (RO) in order to avoid an over-dosage scenario in which a higher dose of corrosion inhibitor is combined into the system. In some cases, the opening of the RO can be controlled by a processor based on, for example, adaptive feedback of measured concentration of corrosion inhibitor chemical in the gas and chemical mixture flowing in the system. The ejector 208 uses a converging nozzle that is distal to the high pressure nozzle and the low pressure nozzle to increase the fluid velocity (from the high pressure gas) to transform high static pressure into velocity pressure. This conversion of static pressure to velocity pressure results in a low pressure zone that provides the motive force to entrain a side fluid. When utilizing high pressure motive gas from existing sources, ejector 208 may have no running costs.

The mixed fluid then flows through a diffuser section comprising a diverging nozzle that then reduces the velocity and increases the pressure, thereby re-compressing the mixed fluid. In this illustration, gas and chemical mixture exits from the diffuser of ejector 208 and travels through flow line 209 before combining with the controlled pressure gas stream exiting from pressure choke valve 203. The mixture then travels through flow line 204 to downstream facilities.

Figure 3:
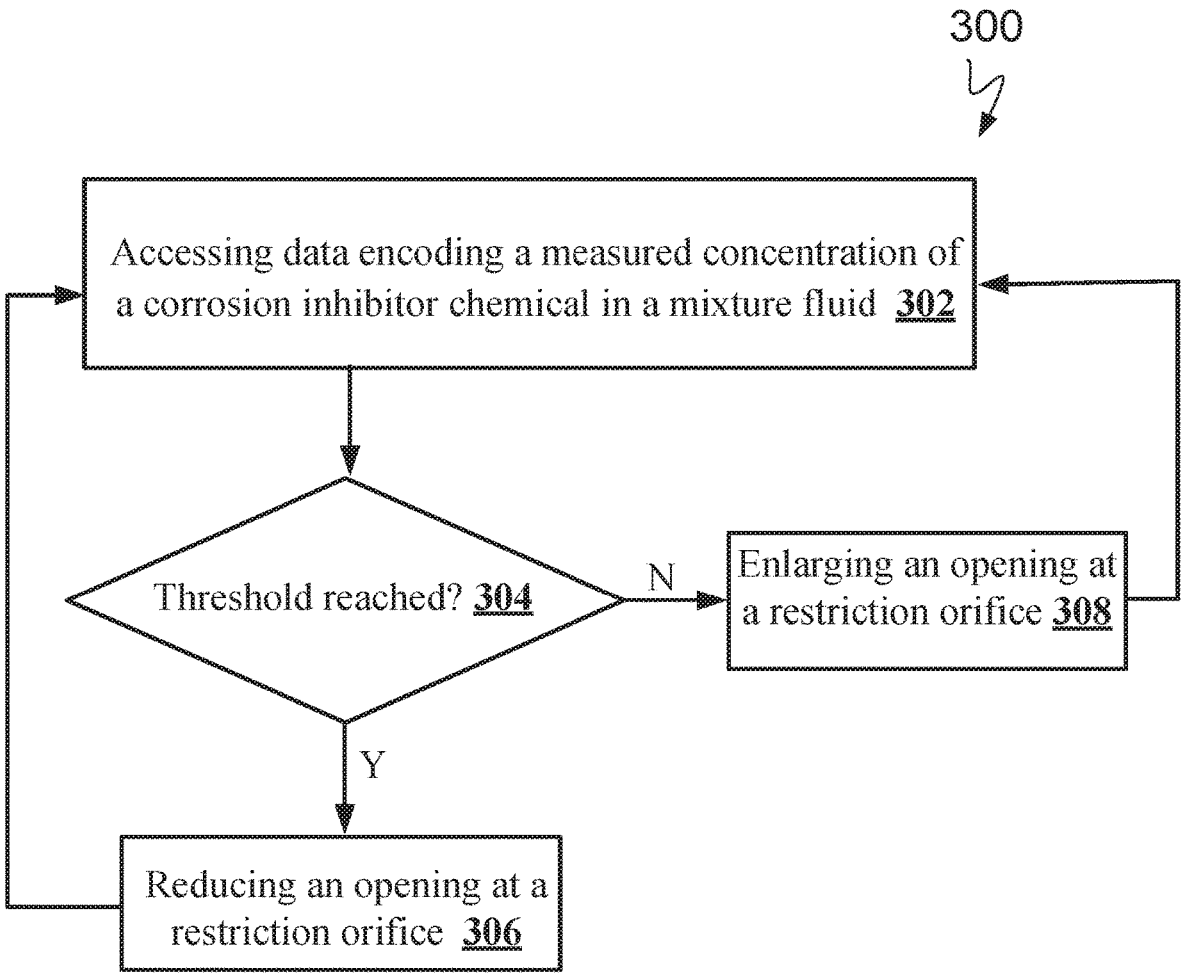
FIG. 3 illustrates an example of a flow chart according to an implementation of the present disclosure.

Referring to FIG. 3, an example of a control process 300 may access data encoding a measurement of a concentration of a corrosion inhibitor chemical in a mixture fluid exiting a wellhead system (302). The measurement may be taken in realtime as the mixture fluid is flowing from the wellhead system to downstream facilities. Some implementations leverage the measurement as a feedback to control a dose of the corrosion inhibitor chemical being released at an ejector device of the wellhead system such that the concentration of the corrosion inhibitor chemical in the mixture exiting the wellhead system is within a pre-determined range. In particular, the measurement may be compared with a pre-determined threshold level (304). In response to determining that the measurement has not reached the pre-determined threshold level, an opening at a restriction orifice may be enlarged (306) such that the amount of the corrosion inhibitor chemical flowing into the ejector device is increased. In response to determining that the measurement has reached the pre-determined threshold level, the opening at the restriction orifice may be reduced such that the amount of the corrosion inhibitor chemical flowing into the ejector device is decreased (308). The restriction orifice may be located at a tank of corrosion inhibitor chemical that is connected to the ejector device. The control process may monitor the concentration of a corrosion inhibitor chemical in the mixture fluid exiting a wellhead system based on continued measurements. The control process may leverage renewable energy (e.g., solar power) harvested locally at the wellhead system to provide power to at least one piece of active equipment of the wellhead system.

Figure 4:
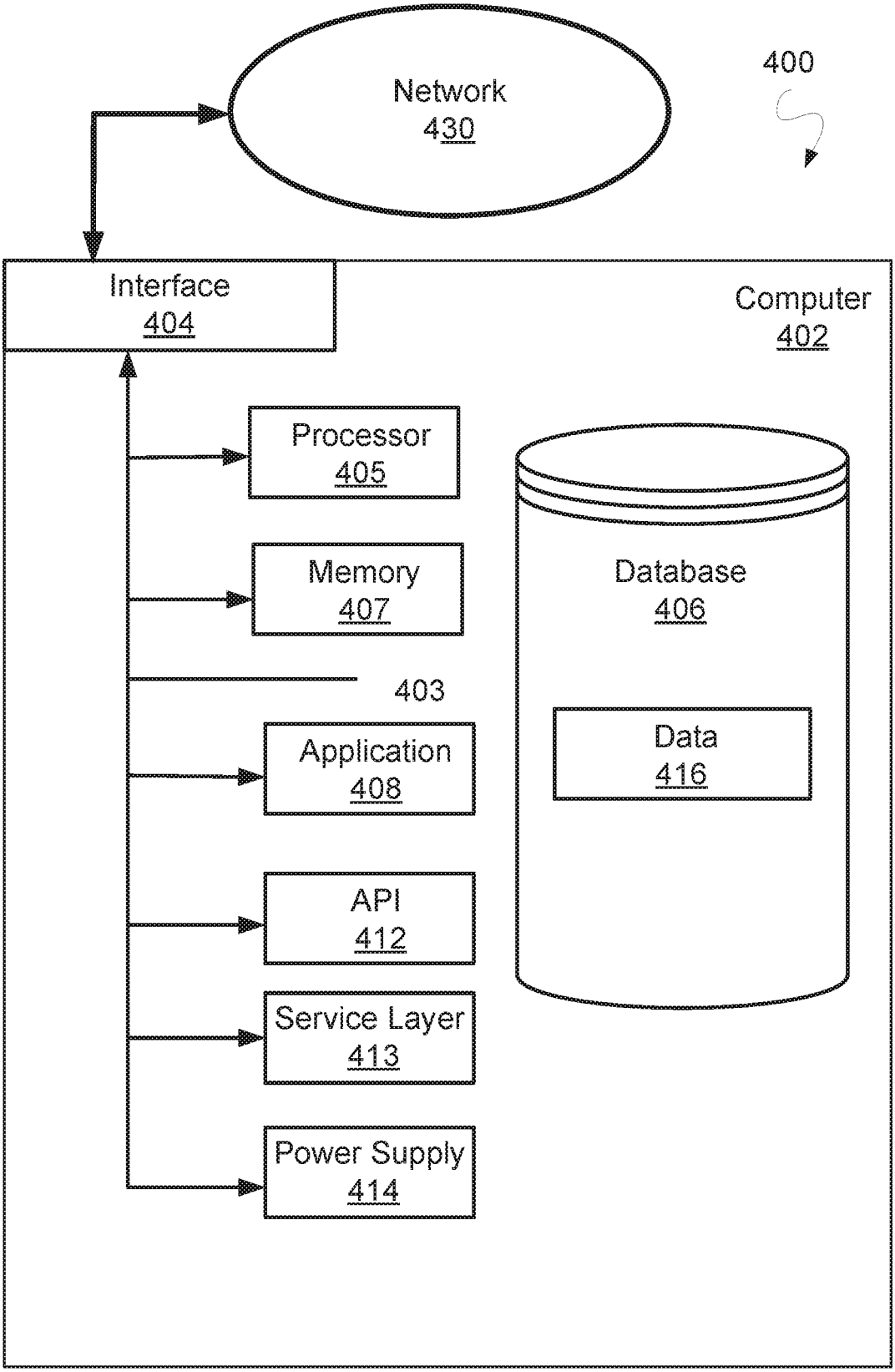
FIG. 4 is a block diagram illustrating an example of a computer system used to provide computational functionalities associated with described algorithms, methods, functions, processes, flows, and procedures, according to an implementation of the present disclosure.

FIG. 4 is a block diagram illustrating an example of a computer system 400 used to provide computational functionalities associated with described algorithms, methods, functions, processes, flows, and procedures, according to an implementation of the present disclosure. The illustrated computer 402 is intended to encompass any computing device such as a server, desktop computer, laptop/notebook computer, wireless data port, smart phone, personal data assistant (PDA), tablet computing device, one or more processors within these devices, another computing device, or a combination of computing devices, including physical or virtual instances of the computing device, or a combination of physical or virtual instances of the computing device. Additionally, the computer 402 can comprise a computer that includes an input device, such as a keypad, keyboard, touch screen, another input device, or a combination of input devices that can accept user information, and an output device that conveys information associated with the operation of the computer 402, including digital data, visual, audio, another type of information, or a combination of types of information, on a graphical-type user interface (UI) (or GUI) or other UI.

The computer 402 can serve in a role in a computer system as a client, network component, a server, a database or another persistency, another role, or a combination of roles for performing the subject matter described in the present disclosure. The illustrated computer 402 is communicably coupled with a network 430. In some implementations, one or more components of the computer 402 can be configured to operate within an environment, including cloud-computing-based, local, global, another environment, or a combination of environments.

The computer 402 is an electronic computing device operable to receive, transmit, process, store, or manage data and information associated with the described subject matter. According to some implementations, the computer 402 can also include or be communicably coupled with a server, including an application server, e-mail server, web server, caching server, streaming data server, another server, or a combination of servers.

The computer 402 can receive requests over network 430 (for example, from a client software application executing on another computer 402) and respond to the received requests by processing the received requests using a software application or a combination of software applications. In addition, requests can also be sent to the computer 402 from internal users, external or third-parties, or other entities, individuals, systems, or computers.

Each of the components of the computer 402 can communicate using a system bus 403. In some implementations, any or all of the components of the computer 402, including hardware, software, or a combination of hardware and software, can interface over the system bus 403 using an application programming interface (API) 412, a service layer 413, or a combination of the API 412 and service layer 413. The API 412 can include specifications for routines, data structures, and object classes. The API 412 can be either computer-language independent or dependent and refer to a complete interface, a single function, or even a set of APIs. The service layer 413 provides software services to the computer 402 or other components (whether illustrated or not) that are communicably coupled to the computer 402. The functionality of the computer 402 can be accessible for all service consumers using this service layer. Software services, such as those provided by the service layer 413, provide reusable, defined functionalities through a defined interface. For example, the interface can be software written in JAVA, C++, another computing language, or a combination of computing languages providing data in extensible markup language (XML) format, another format, or a combination of formats. While illustrated as an integrated component of the computer 402, alternative implementations can illustrate the API 412 or the service layer 413 as stand-alone components in relation to other components of the computer 402 or other components (whether illustrated or not) that are communicably coupled to the computer 402. Moreover, any or all parts of the API 412 or the service layer 413 can be implemented as a child or a sub-module of another software module, enterprise application, or hardware module without departing from the scope of the present disclosure.

The computer 402 includes an interface 404. Although illustrated as a single interface 404 in FIG. 4, two or more interfaces 404 can be used according to particular needs, desires, or particular implementations of the computer 402. The interface 404 is used by the computer 402 for communicating with another computing system (whether illustrated or not) that is communicatively linked to the network 430 in a distributed environment. Generally, the interface 404 is operable to communicate with the network 430 and comprises logic encoded in software, hardware, or a combination of software and hardware. More specifically, the interface 404 can comprise software supporting one or more communication protocols associated with communications such that the network 430 or interface's hardware is operable to communicate physical signals within and outside of the illustrated computer 402.

The computer 402 includes a processor 405. Although illustrated as a single processor 405 in FIG. 4, two or more processors can be used according to particular needs, desires, or particular implementations of the computer 402. Generally, the processor 405 executes instructions and manipulates data to perform the operations of the computer 402 and any algorithms, methods, functions, processes, flows, and procedures as described in the present disclosure.

The computer 402 also includes a database 406 that can hold data for the computer 402, another component communicatively linked to the network 430 (whether illustrated or not), or a combination of the computer 402 and another component. For example, database 406 can be an in-memory, conventional, or another type of database storing data consistent with the present disclosure. In some implementations, database 406 can be a combination of two or more different database types (for example, a hybrid in-memory and conventional database) according to particular needs, desires, or particular implementations of the computer 402 and the described functionality. Although illustrated as a single database 406 in FIG. 4, two or more databases of similar or differing types can be used according to particular needs, desires, or particular implementations of the computer 402 and the described functionality. While database 406 is illustrated as an integral component of the computer 402, in alternative implementations, database 406 can be external to the computer 402. As illustrated, the database 406 holds the previously described data 416 including, for example, multiple streams of data from various sources, such as the pressure gauging, and inhibitor monitoring at, for example, the ejector device.

The computer 402 also includes a memory 407 that can hold data for the computer 402, another component or components communicatively linked to the network 430

(whether illustrated or not), or a combination of the computer 402 and another component. Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 or similar or differing types can be used according to particular needs, desires, or particular implementations of the computer 402 and the described functionality. While memory 407 is illustrated as an integral component of the computer 402, in alternative implementations, memory 407 can be external to the computer 402.

The application 408 is an algorithmic software engine providing functionality according to particular needs, desires, or particular implementations of the computer 402, particularly with respect to functionality described in the present disclosure. For example, application 408 can serve as one or more components, modules, or applications. Further, although illustrated as a single application 408, the application 408 can be implemented as multiple applications 408 on the computer 402. In addition, although illustrated as integral to the computer 402, in alternative implementations, the application 408 can be external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion or management circuits (including recharging, standby, or another power management functionality). In some implementations, the power-supply 414 can include a power plug to allow the computer 402 to be plugged into a wall socket or another power source to, for example, power the computer 402 or recharge a rechargeable battery.

There can be any number of computers 402 associated with, or external to, a computer system containing computer 402, each computer 402 communicating over network 430. Further, the term "client," "user," or other appropriate terminology can be used interchangeably, as appropriate, without departing from the scope of the present disclosure. Moreover, the present disclosure contemplates that many users can use one computer 402, or that one user can use multiple computers 402.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal, for example, a machine-generated electrical, optical, or electromagnetic signal that is generated to encode information for transmission to a receiver apparatus for execution by a data processing apparatus. The computer-storage medium can be a machine-readable storage device, a machine-readable storage substrate, a random or serial access memory device, or a combination of computer-storage mediums. Configuring one or more computers means that the one or more computers have installed hardware, firmware, or software (or combinations of hardware, firmware, and software) so that when the software is executed by the one or more computers, particular computing operations are performed.

The term "real-time," "real time," "realtime," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second (s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be, or further include special purpose logic circuitry, for example, a central processing unit (CPU), an FPGA (field programmable gate array), or an ASIC (application-specific integrated circuit). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with an operating system of some type, for example LINUX, UNIX, WINDOWS, MAC OS, ANDROID, IOS, another operating system, or a combination of operating systems.

A computer program, which can also be referred to or described as a program, software, a software application, a unit, a module, a software module, a script, code, or other component can be written in any form of programming language, including compiled or interpreted languages, or declarative or procedural languages, and it can be deployed in any form, including, for example, as a stand-alone program, module, component, or subroutine, for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network.

While portions of the programs illustrated in the various figures can be illustrated as individual components, such as units or modules, that implement described features and functionality using various objects, methods, or other processes, the programs can instead include a number of sub-units, sub-modules, third-party services, components, libraries, and other components, as appropriate. Conversely, the features and functionality of various components can be combined into single components, as appropriate. Thresholds used to make computational determinations can be statically, dynamically, or both statically and dynamically determined.

Described methods, processes, or logic flows represent one or more examples of functionality consistent with the present disclosure and are not intended to limit the disclosure to the described or illustrated implementations, but to be accorded the widest scope consistent with described principles and features. The described methods, processes, or logic flows can be performed by one or more programmable computers executing one or more computer programs to perform functions by operating on input data and generating output data. The methods, processes, or logic flows can also be performed by, and apparatus can also be implemented as, special purpose logic circuitry, for example, a CPU, an FPGA, or an ASIC.

Computers for the execution of a computer program can be based on general or special purpose microprocessors, both, or another type of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable memory storage device.

Non-transitory computer-readable media for storing computer program instructions and data can include all forms of media and memory devices, magnetic devices, magneto optical disks, and optical memory device. Memory devices include semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Magnetic devices include, for example, tape, cartridges, cassettes, internal/removable disks. Optical memory devices include, for example, digital video disc (DVD), CD-ROM, DVD+/−R, DVD-RAM, DVD-ROM, HD-DVD, and BLURAY, and other optical memory technologies. The memory can store various objects or data, including caches, classes, frameworks, applications, modules, backup data, jobs, web pages, web page templates, data structures, database tables, repositories storing dynamic information, or other appropriate information including any parameters, variables, algorithms, instructions, rules, constraints, or references. Additionally, the memory can include other appropriate data, such as logs, policies, security or access data, or reporting files. The processor and the memory can be supplemented by, or incorporated in, special purpose logic circuitry.

To provide for interaction with a user, implementations of the subject matter described in this specification can be implemented on a computer having a display device, for example, a CRT (cathode ray tube), LCD (liquid crystal display), LED (Light Emitting Diode), or plasma monitor, for displaying information to the user and a keyboard and a pointing device, for example, a mouse, trackball, or trackpad by which the user can provide input to the computer. Input can also be provided to the computer using a touchscreen, such as a tablet computer surface with pressure sensitivity, a multi-touch screen using capacitive or electric sensing, or another type of touchscreen. Other types of devices can be used to interact with the user. For example, feedback provided to the user can be any form of sensory feedback. Input from the user can be received in any form, including acoustic, speech, or tactile input. In addition, a computer can interact with the user by sending documents to and receiving documents from a client computing device that is used by the user.

The term "graphical user interface," or "GUI," can be used in the singular or the plural to describe one or more graphical user interfaces and each of the displays of a particular graphical user interface. Therefore, a GUI can represent any graphical user interface, including but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with the present disclosure), all or a portion of the Internet, another communication network, or a combination of communication networks. The communication network can communicate with, for example, Internet Protocol (IP) packets, Frame Relay frames, Asynchronous Transfer Mode (ATM) cells, voice, video, data, or other information between networks addresses.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of what can be claimed, but rather as descriptions of features that can be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features can be described as acting in certain combinations and even initially claimed as such, one or more features from a claimed combination can, in some cases, be excised from the combination, and the claimed combination can be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations can be considered optional), to achieve desirable results. In certain circumstances, multitasking or parallel processing (or a combination of multitasking and parallel processing) can be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A wellhead system, comprising:

a wellhead;

a tank of corrosion inhibitor chemical; and an ejector device configured as a stationary installation without a rotating component that includes a reciprocating pump, the ejector device comprising:

a high pressure nozzle connected to the wellhead through a first flowline;

a low pressure nozzle connected to the tank of the corrosion inhibitor chemical through a second flowline; and wherein the ejector device is configured to generate a gas and chemical mixture fluid that, when exiting the ejector device, flows away from the wellhead and downstream of the wellhead system.

2. The wellhead system of claim 1, wherein the ejector device further comprises:

a converging nozzle distal to the high pressure nozzle and the low pressure nozzle, wherein the converging nozzle is configured to convert a pressure of fluid from the first flowline to create a low pressure zone that provides a motive gas to entrain fluid from the second flowline such that the gas and chemical mixture fluid is created.

3. The wellhead system of claim 2, wherein the fluid from the second flowline contains sufficient dose of a corrosion inhibitor chemical to protect pipelines downstream of the wellhead system from corrosion.

4. The wellhead system of claim 2, wherein the converging nozzle is configured to increase a fluid velocity of the fluid from the first flowline such that a high static pressure of the fluid from the first flowline is transformed into a velocity pressure that results in the low pressure zone.

5. The wellhead system of claim 2, wherein the ejector device further comprises a diffuser section located distal to the converging nozzle.

6. The wellhead system of claim 5, wherein the diffuser section comprises a diverging nozzle configured to reduce a velocity of the gas and chemical mixture fluid and increase a pressure of the gas and chemical mixture fluid such that the gas and chemical mixture fluid is re-compressed before exiting the ejector device.

7. The wellhead system of claim 6, wherein the gas and chemical mixture fluid exits the ejector device to reach facilities downstream of the wellhead system.

8. The wellhead system of claim 1, wherein the tank of corrosion inhibitor chemical comprises a restriction orifice (RO).

9. The wellhead system of claim 8, wherein the restriction orifice is configured to restrict a dosage of the corrosion inhibitor chemical being released at the ejector device.

10. The wellhead system of claim 8, wherein the restriction orifice is configured to avoid an over-dosage of the corrosion inhibitor chemical being released at the ejector device.

11. The wellhead system of claim 1, further comprising:

a pressure choke valve connected to the wellhead through a third flowline.

12. The wellhead system of claim 11, wherein the pressure choke valve is configured to drop a pressure of fluid from the third flowline.

13. The wellhead system of claim 11, wherein the ejector device is located upstream of the pressure choke valve.

14. The wellhead system of claim 1, further comprising:

a communication device configured to communicate data encoding a measured concentration of the corrosion inhibitor chemical in the gas and chemical mixture fluid.

15. A computer-implemented method, comprising:

accessing data encoding a measurement of a concentration of a corrosion inhibitor chemical in a mixture fluid exiting a wellhead system; and controlling a dose of the corrosion inhibitor chemical being released at an ejector device of the wellhead system such that the concentration of the corrosion inhibitor chemical in the mixture fluid exiting the wellhead system is within a pre-determined range, wherein the ejector device is configured to generate the mixture fluid that, when exiting the ejector device, flows away from a wellhead of the wellhead system and downstream of the wellhead system.

16. The computer-implemented method of claim 15, further comprising in response to the concentration being lower than a pre-determined threshold level, enlarging an opening of a restriction orifice (RO) at a tank of the corrosion inhibitor chemical such that a quantity of the corrosion inhibitor chemical being released at the ejector device of the wellhead system is increased.

17. The computer-implemented method of claim 15, further comprising in response to the concentration being higher than a pre-determined threshold level, reducing an opening of a restriction orifice (RO) at a tank of the corrosion inhibitor chemical such that a quantity of the corrosion inhibitor chemical being released at the ejector device of the wellhead system is decreased.

18. The computer-implemented method of claim 15, further comprising:

applying renewable energy to power at least one piece of active equipment of the wellhead system, wherein the renewable energy is harvested onsite at the wellhead system.

19. The computer-implemented method of claim 15, further comprising:

monitoring the concentration of the corrosion inhibitor chemical in the mixture fluid exiting the wellhead system.

* * * * *